US005176606A

United States Patent [19]

Budjinski, III et al.

[11] Patent Number: 5,176,606

[45] Date of Patent: Jan. 5, 1993

[54] LAMINATED BELT FOR FILTER ROD MAKING APPARATUS

[75] Inventors: Joseph F. Budjinski, III, Quinton; Charles G. Atwell, Mechanicsville; Martin T. Garthaffner, Midlothian; Marc D. Belcastro, Glen Allen, all of Va.

[73] Assignee: Philip Morris Incorporated, New York, N.Y.

[21] Appl. No.: 829,876

[22] Filed: Jan. 31, 1992

[51] Int. Cl.[5] ..... A24D 3/02

[52] U.S. Cl. ..... 493/47; 493/48

[58] Field of Search ..... 493/42, 44, 46, 47, 493/48, 49

[56] References Cited

U.S. PATENT DOCUMENTS

| | | | |
|---|---|---|---|
| 3,367,245 | 2/1968 | Wisdom | 493/47 |
| 3,464,324 | 9/1969 | Pinkham | 93/1 |
| 3,610,112 | 10/1971 | Labbe | 93/1 C |
| 3,623,404 | 11/1971 | Jackson | 93/1 C |
| 4,285,678 | 8/1981 | Molins | 493/48 |
| 4,541,826 | 9/1985 | Warner | 493/48 |
| 4,861,324 | 8/1989 | Hirose et al. | 493/48 |

*Primary Examiner*—William E. Terrell

[57] ABSTRACT

This invention relates to a laminated belt for use in a machine which delivers free flowing material into receiving spaces in between filter plugs. The belt of this invention is a lamination of a metal band and a composition strap perforated with a plurality of apertures. This belt travels in part parallel with and adjacent to a garniture tape carrying filter plugs separated by receiving spaces. The composition strap is shaped to conform to the round shape of the filter plugs, and it contacts the filter plugs, urging them against the garniture tape. The belt and the garniture tape are synchronized so that the receiving spaces precisely register with the apertures in the belt, while an independent device delivers free flowing material through the apertures into the receiving spaces. By urging the filter plugs against the garniture tape, the belt holds the filter plugs in this registered position on the garniture tape. Non-apertured portions of the laminated belt screen the filter plugs from exposure to free flowing material.

6 Claims, 5 Drawing Sheets

LAMINATED BELT FOR FILTER ROD MAKING APPARATUS

BACKGROUND OF THE INVENTION

The present invention is directed to a laminated belt for use in a device which delivers free flowing material into receiving spaces separating filter plugs, as the plugs move on a conveyor (in the tobacco art, such a conveyor is called a garniture tape).

Several devices in the prior art which insert free flowing material between filter plugs utilize belts. For example, U.S. Pat. No. 4,285,678 includes a belt. This belt travels around a plurality of wheels. During a portion of this travel, the belt moves parallel with and above the garniture tape. The garniture tape carries a row of axially aligned filter plugs separated by receiving spaces so that the filter plugs travel between the garniture tape and the belt. The belt includes apertures registered with the receiving spaces separating the filter plugs. These apertures direct the free flowing material into the receiving spaces. The blank portions of the belt screen the filter plugs from exposure to the free flowing material.

Likewise, U.S. Pat. No. 3,464,324 includes a belt which travels over a row of filter plugs transported on a garniture tape (called a travelling folding tape in that patent). Granular material is deposited through apertures in this belt into the spaces between the plugs. The apertures in the belt are timed to register with the receiving spaces between the filter plugs.

These belts in the prior art help screen the filter plugs from exposure to the free flowing material. However, these belts do not hold the filter plugs in a stable position on the rapidly moving garniture tape. Positioning the filter plug between the garniture tape and the laminated belt would help to maintain the spaced positioning of the filter plugs as the garniture tape transports them at very high speeds.

It would be desirable to replace these belts in the prior art with a metal belt laminated with a composition strap. Such a strap, shaped to conform to the shape of the filter plug, would help to securely position the filter plug against the garniture tape at high speeds. Such secure positioning would help insure the accurate registry of the apertures in the belt with the receiving spaces between the plugs. The overall advantage of such a strap would be to allow the delivery devices to operate at speeds beyond those attainable with belts presently used.

SUMMARY OF THE INVENTION

In view of the foregoing, it is an object of the invention to provide a laminated belt for use in a device which delivers free flowing material into receiving spaces between filter plugs.

It is a further object to deliver free flowing material accurately into receiving spaces between filter plugs travelling at high speeds on a garniture tape.

It is a further object to protect the filter plugs from exposure to the free flowing material.

These and other objects of the invention are accomplished by providing a belt which is a lamination of a metal band and a composition strap. This laminated belt travels around a plurality of wheels on a course in part parallel with and adjacent to that of a garniture tape carrying axially aligned filter plugs. The composition strap conforms to the round shape of the filter plugs carried by the garniture tape. During their parallel travel, the laminated belt urges the filter plugs against the garniture tape thereby holding the plugs in place.

A plurality of apertures extend completely through the belt. An independent means synchronizes the motion of the laminated belt with that of the garniture tape so that the apertures through the belt register with the receiving spaces between the filter plugs. Likewise, the blank portions of the belt register with the filter plugs, screening the filter plugs from exposure to the free flowing material. By urging the plugs against the garniture tape, the laminated belt holds the plugs securely in this registered configuration. A device known in the art, the charcoal chute, delivers particulate matter through the apertures in the belt into the receiving spaces separating the plugs.

By securely holding the filter plugs against the garniture tape, this laminated belt maintains registry of the belt apertures with the receiving spaces, even as the garniture tape transports the plugs at high speeds. Such stable registry allows for accurate delivery of free flowing material at very high speeds, while the laminated belt masks the filter plugs from exposure to the free flowing material.

BRIEF DESCRIPTION OF THE DRAWINGS

The above and other objects and advantages of the invention will be apparent upon consideration of the following detailed description, taken in conjunction with the accompanying drawings, in which like reference numerals refer to like parts throughout, and in which.

DETAILED DESCRIPTION OF THE PREFERRED EMBODIMENTS

Figure 1:
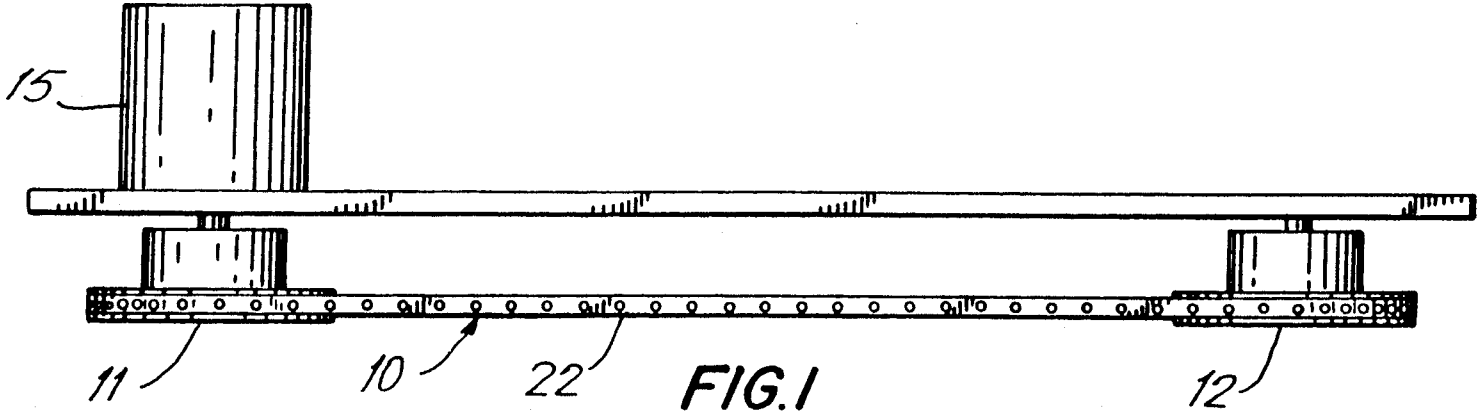
FIG. 1 is a top plan view illustrating diagrammatically the basic relationship between the laminated belt and the wheels and motor.
Figure 2:
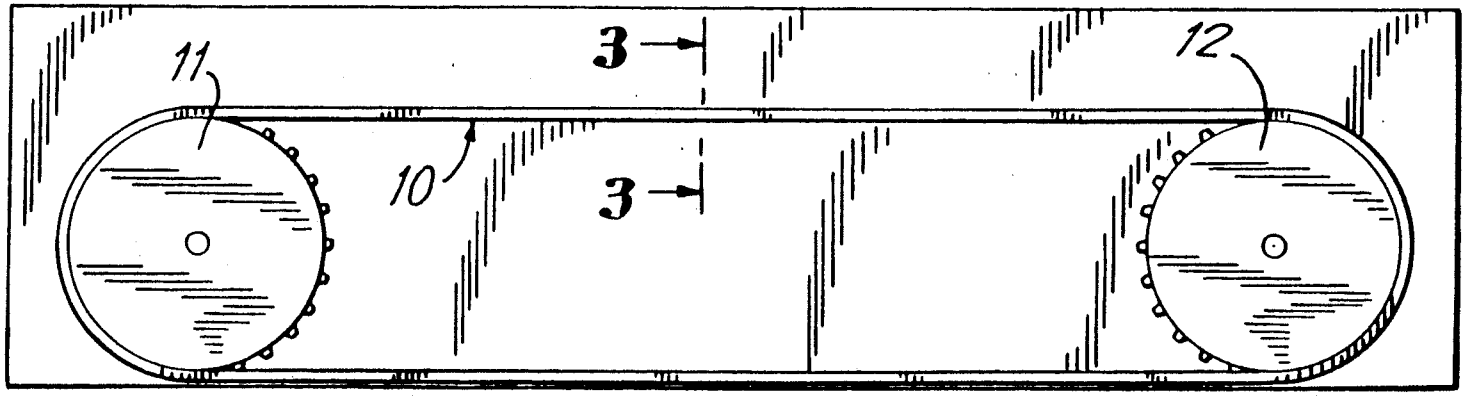
FIG. 2 is a full frontal view of the apparatus of FIG. 1.
Figure 3:
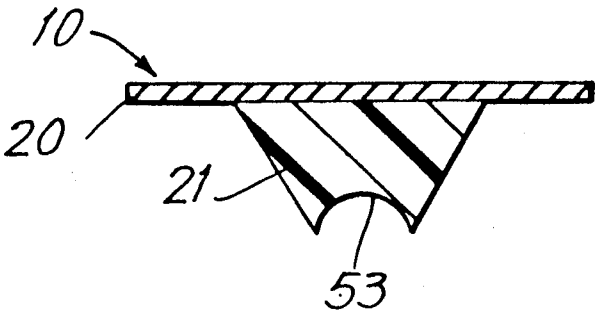
FIG. 3 is a sectional view on line I of FIG. 2.
Figure 4:
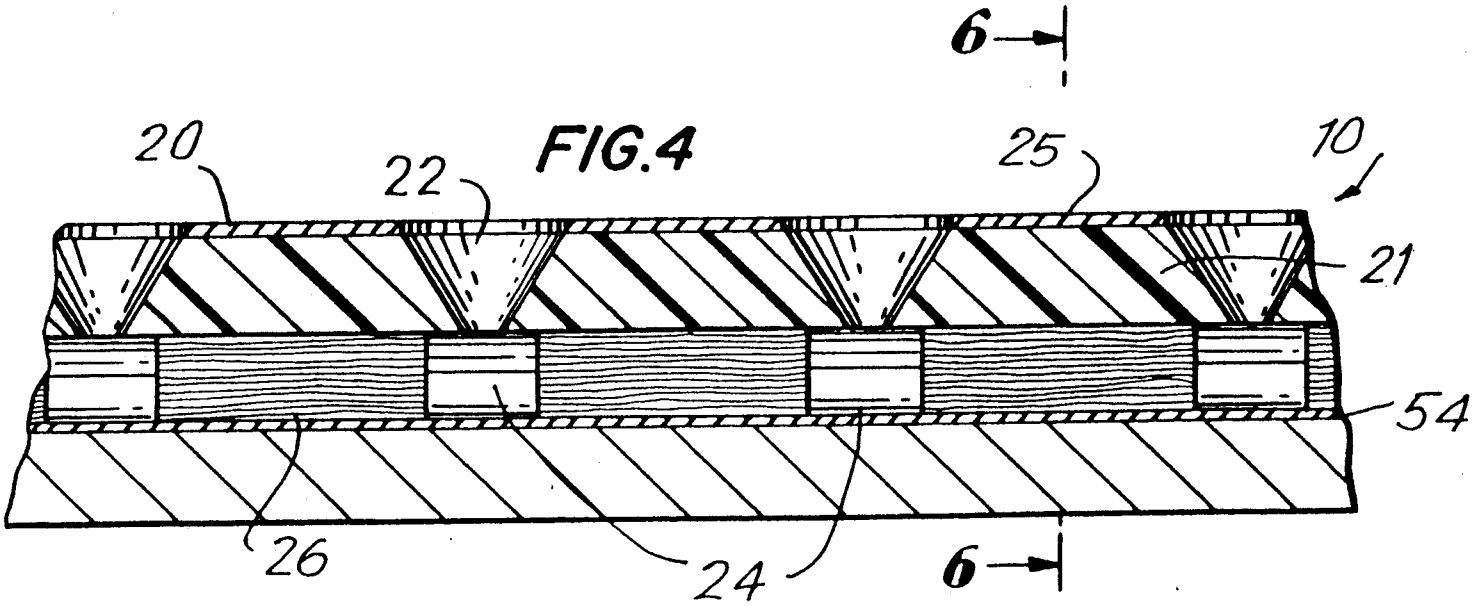
FIG. 4 is a frontal sectional view in fragmentary form of the laminated belt of FIGS. 1 and 2, illustrating the basic relationship of the laminated belt to the filter plugs.
Figure 5:
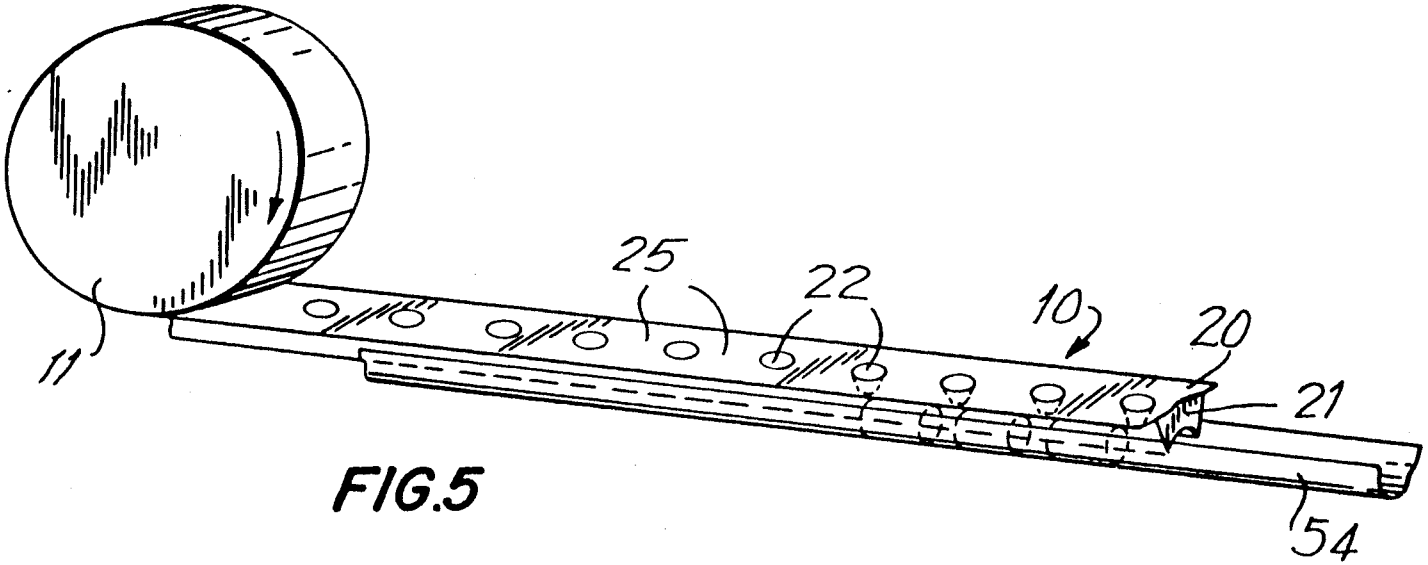
FIG. 5 is a perspective view in fragmentary form, illustrating diagrammatically the basic relationship between the laminated belt and a wheel.
Figure 6:
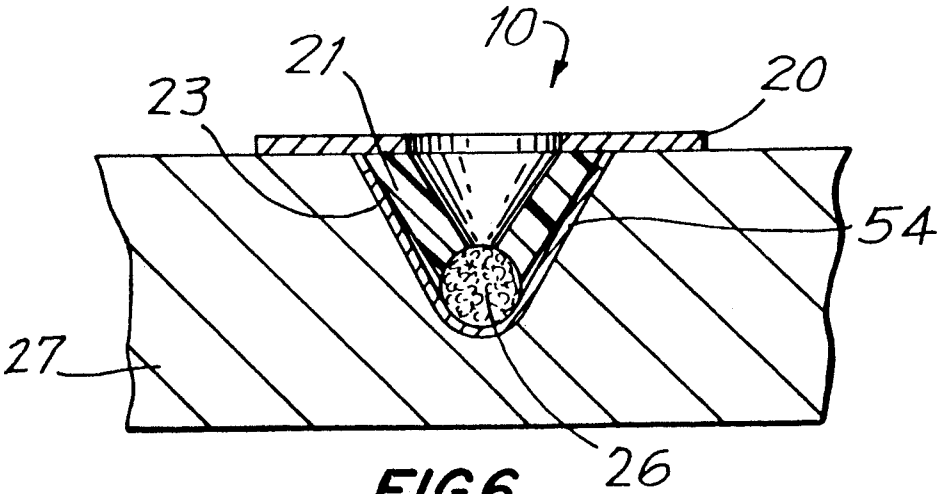
FIG. 6 is a sectional view on line II of FIG. 4 illustrating the basic relationship of the laminated belt to the track, the garniture tape and the package.

Referring to the drawings, FIGS. 1 through 6 illustrate the laminated belt designated generally by reference numeral 10. Laminated belt 10 travels around a plurality of wheels, including a drive wheel 11 and an idler wheel 12. Motor 15 powers drive wheel 11 which in turn applies power to move belt 10. Idler wheel 12 provides tension and position for laminated belt 10.

Laminated belt 10 is a lamination of metal band 20 and a composition strap 21. Metal band 20 engages directly with wheels 11 and 12. Composition strap 21 is laminated onto the side of metal band 20 opposite the wheels. Composition strap 21 may be formed of neoprene or other suitable composition materials. The neoprene composition strap 21 is molded from liquid neoprene, which directly bonds to the metal band 20 without the need for adhesive. The composition strap 21 terminates in a concave shape 53. This concave shape 53 closely conforms to the round shape of filter plugs 26 in the partially constructed cigarette filters. Apertures 22 extend through both the metal band 20 and composition strap 21 portions of belt 10.

A flexible conveyor belt, the garniture tape 54, conveys filter plugs 26 separated by receiving spaces 24 along a course parallel with and beneath belt 10. The garniture tape 54 travels through a trough called a garniture 23. Garniture 23 is concave shaped. While garniture tape 54 travels through garniture 23, the garniture tape 54 assumes this concave shape. This concave shaped garniture tape accommodates the round shape of the axially aligned filter plugs 26 it conveys.

During the parallel travel of garniture tape 54 with the laminated belt 10, the composition strap 21 portion of laminated belt 10 contacts the filter plugs 26. During this contact, the composition strap 21 urges the filter plugs 26 against garniture tape 54 thus holding plugs 26 in a stable position.

An independent device known in the art, the synchronous drive, synchronizes the movement of laminated belt 10 with garniture tape 54 so that apertures 22 of belt 10 register with receiving spaces 24 between filter plugs 26. An independent device known in the art, the charcoal chute, delivers free flowing material through apertures 22 into receiving spaces 24. Concurrently, the non-apertured portions 25 of belt 10 mask the filter plugs 26 from exposure to the free flowing material.

By urging filter plugs 26 against garniture tape 54, composition strap 21 of belt 10 acts to firmly position filter plugs 26 as they are conveyed at high speeds on garniture tape 54. Such stable positioning maintains the accurate registry of apertures 22 with receiving spaces 24. Thus the stable positioning provided by belt 10 facilitates the accurate delivery of free flowing material into the receiving spaces 24 between filter plugs 26 as the plugs move at high speeds on garniture tape 54.

Figure 7:
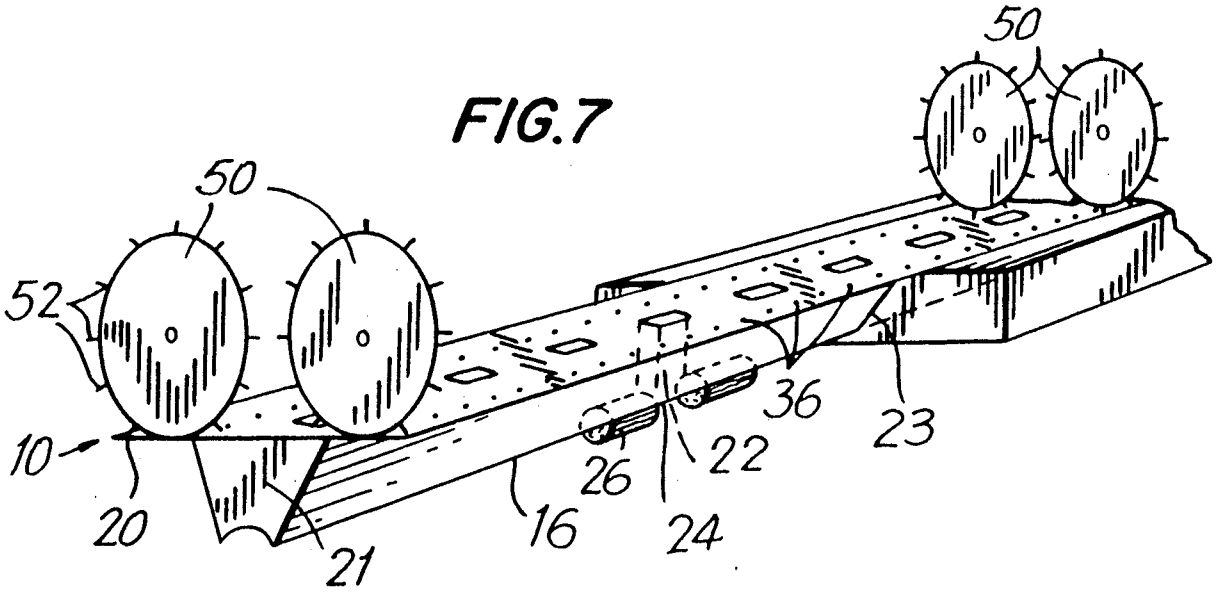
FIG. 7 is a perspective view of an alternative embodiment of the wheel and the laminated belt of FIG. 2.

In one alternative embodiment represented in FIG. 7, laminated belt 10 includes apertures 36 along both lateral edges of the belt. Belt 10 travels around a plurality of wheels 50, each wheel including a row of radially extending teeth 52 positioned around its circumference. The teeth 52 of wheels 50 engage with the apertures 36 of laminated belt 10. In a similar alternative embodiment represented in FIG. 8, laminated belt 10 travels around single end wheels 51 each with a parallel pair of radially extending teeth 52 positioned around its circumference. The teeth 52 of wheels 51 engage with the apertures 36 of laminated belt 10.

Figure 8:
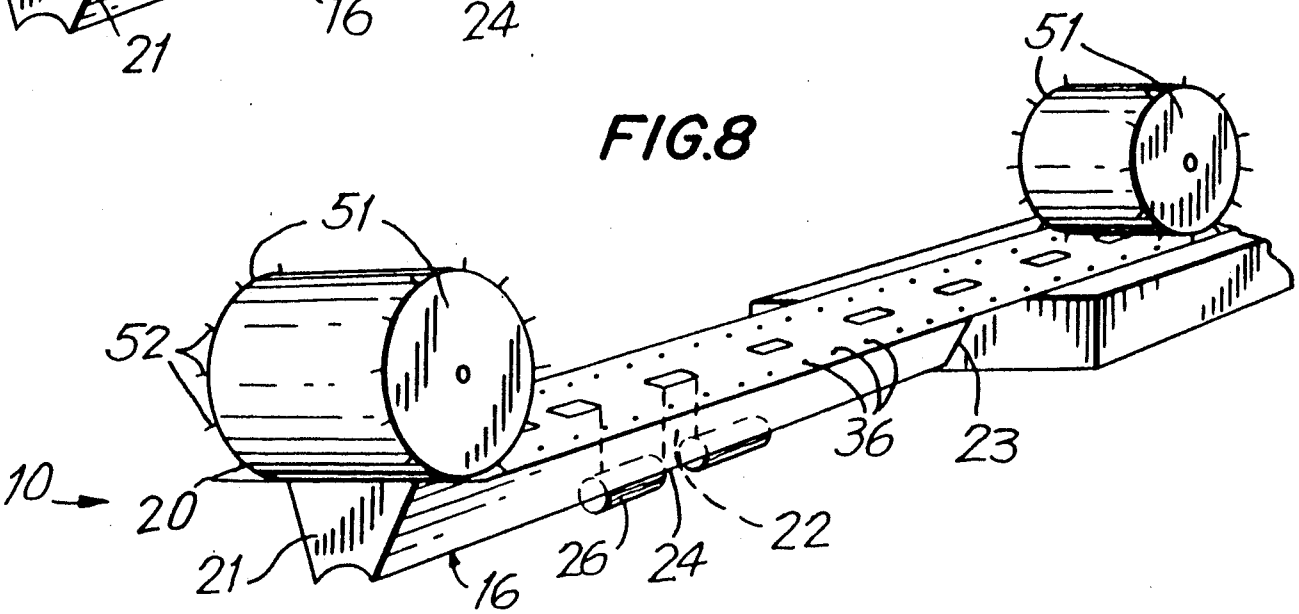
FIG. 8 is a perspective view of an alternative embodiment of the wheel and the laminated belt of FIG. 2.
Figure 9:
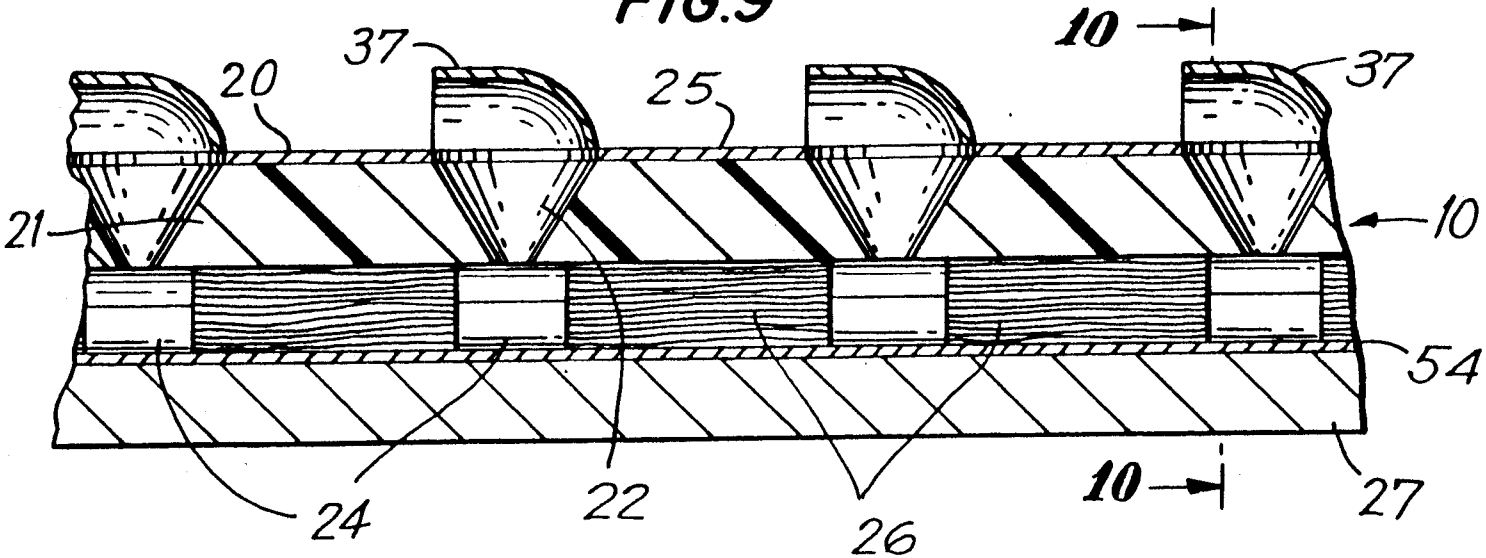
FIG. 9 is a frontal sectional view in fragmentary form of an alternative embodiment of the laminated belt of FIGS. 1 and 2.
Figure 11:
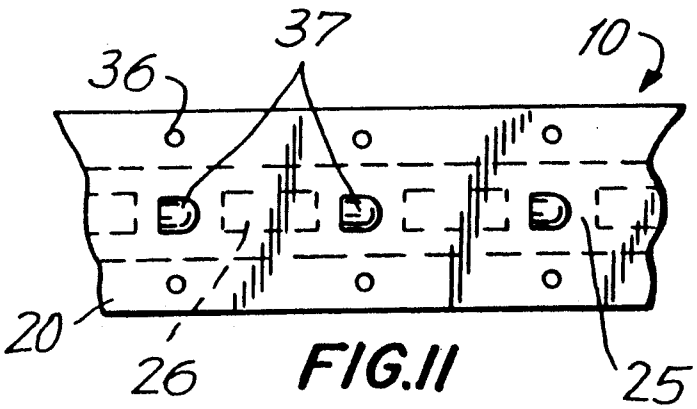
FIG. 11 is a top plan view of an alternative embodiment of the laminated belt of FIG. 9.
Figure 10:
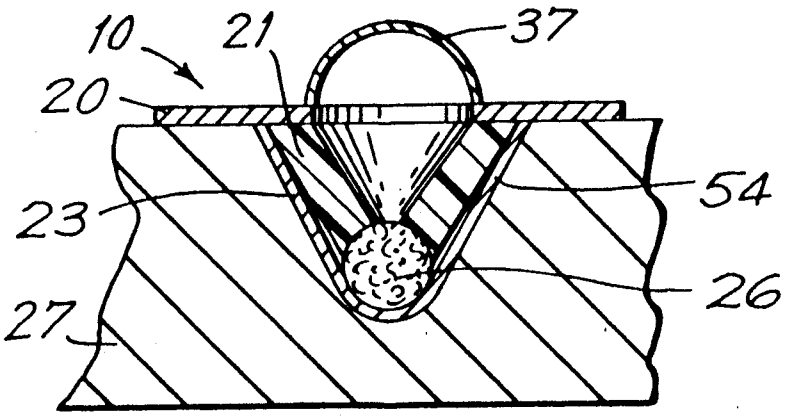
FIG. 10 is a sectional view on line III of FIG. 9.

In the embodiments represented in FIGS. 7 and 8, apertures 22 extend through laminated belt 10 between the lateral rows of sprocket engaging apertures 36. Apertures 22 serve as ports through which a standard device known in the art delivers free flowing material to receiving spaces 24. These embodiments may utilize forward facing louvers 37, represented in FIGS. 9, 10, and 11, positioned above apertures 22 in the middle of belt 10. These louvers 37 work to capture particulate matter like a scoop.

One skilled in the art will appreciate that the present invention can be practiced by other than the described embodiments, which are presented for purposes of illustration and not of limitation and the present invention is limited only by the claims which follow.

We claim:

1. In an apparatus for inserting free flowing particulate material into receiving spaces between filter plugs for constructing cigarette filters, the improvement comprising, a laminated belt comprising a metal band with a composition strap laminated on one side, the belt further having apertures and travelling in part parallel with and adjacent to a garniture tape carrying the filter plugs, while the apertures in the belt channel the particulate matter from a source into the receiving spaces between the filter plugs and non-apertured parts of the belt mask the filter plugs from the particulate material, said strap adapted to receive filter plugs located along said garniture tape.

2. The apparatus according to claim 1 wherein the belt travels around a plurality of wheels so that the metal band contacts the wheels, the composition strap being laminated onto the side of the band away from the wheels.

3. The apparatus according to claim 2 wherein the laminated belt has regularly spaced perforations positioned near both lateral edges of the laminated belt which engage teeth positioned around the circumference of the wheels, and the set of apertures is in the middle of the laminated belt for admitting the particulate material into receiving spaces between the filter plugs.

4. The apparatus according to claim 3, wherein the laminated belt has a set of forward facing louvers projecting over the apertures in the middle of said laminated belt which scoop free flowing material into the apertures.

5. The apparatus according to claim 1 wherein the composition strap contacts the filter plugs as the laminated belt travels parallel with and adjacent to the garniture tape, the composition strap conforming to the shape of the filter plugs and the laminated belt urging the filter plugs against the garniture tape.

6. The apparatus according to claim 1 wherein the laminated belt and the garniture tape operate in synchronization so that the apertures in the laminated belt register with the receiving spaces between the filter plugs delivered by the garniture tape, the laminated belt holding the filter plugs in the registered position by urging them against the garniture tape.

* * * * *